United States Patent [19]

Bellamy et al.

[11] 4,148,677

[45] Apr. 10, 1979

[54] METHOD OF AND APPARATUS FOR TAPING AN ARTICLE

[75] Inventors: William G. Bellamy, Winston-Salem; John G. Tucker, Lexington; Hugh A. Wells, Winston-Salem, all of N.C.

[73] Assignee: Western Electric Company, Incorporated, New York, N.Y.

[21] Appl. No.: 844,083

[22] Filed: Oct. 20, 1977

[51] Int. Cl.[2] ..... B65H 81/00

[52] U.S. Cl. ..... 156/187; 156/446; 156/450; 242/56 R; 242/7.08

[58] Field of Search ..... 156/443, 446, 475, 184–185, 156/187, 188, 190–192, 522, 447–450, 212, 215; 242/56 R, 56.1, 7.08, 7.23

[56] References Cited

U.S. PATENT DOCUMENTS

| | | | |
|---|---|---|---|
| 3,159,325 | 12/1964 | Toensing | 226/150 |
| 3,314,452 | 4/1967 | Cartwright | 140/92.2 |
| 3,350,255 | 10/1967 | Twigg | 242/56 R X |
| 3,380,873 | 4/1968 | Angst | 156/446 |
| 3,471,098 | 10/1969 | Jannett | 242/56.1 |
| 3,713,599 | 1/1973 | Smith et al. | 242/7.11 |
| 3,834,963 | 9/1974 | Hoffman | 156/215 |
| 3,970,259 | 7/1976 | Schmid | 242/56 R X |
| 3,984,276 | 10/1976 | Stuart | 156/446 |
| 4,055,310 | 10/1977 | Bonaiti | 242/7.08 |
| 4,070,227 | 1/1978 | Stuart | 156/446 |

*Primary Examiner*—David A. Simmons
*Attorney, Agent, or Firm*—D. D. Bosben

[57] ABSTRACT

In winding tape on an article a preselected length of the tape is collected from a tape supply and the collected tape is severed from the supply to form a trailing end portion on the collected tape. The trailing end portion of the collected tape then is attached to the article and the article is rotated to wind the collected tape onto the article without any significant back tension in the tape which could damage the article. Preferably, the collected tape is moved from a collecting position to a position adjacent the article between the tape severing and tape attaching operations, to eliminate twisting and misalignment of the tape as it is transferred to the article, and possible damage to the article. The tape collecting operation also preferably involves winding the tape onto a rotatable tape collecting member in a small compact package, to reduce the size of the apparatus required.

18 Claims, 18 Drawing Figures

FIG. 5
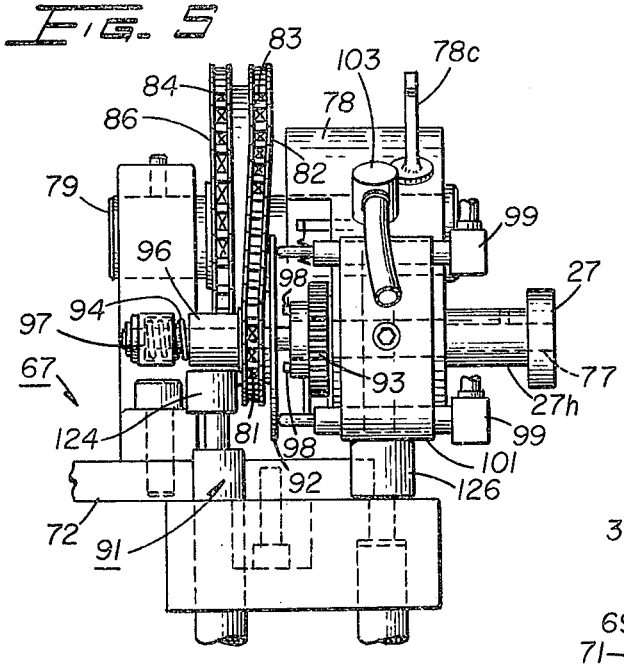
FIG. 6
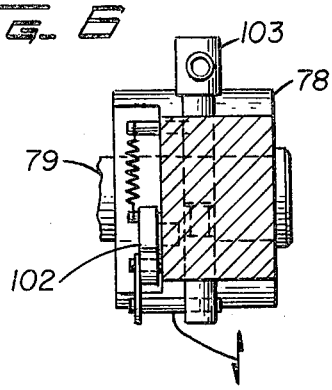
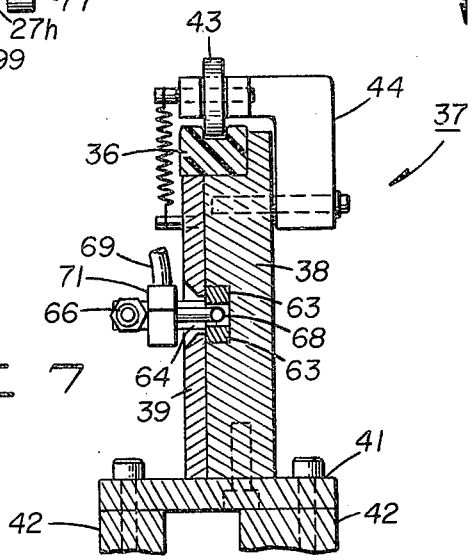
FIG. 7
FIG. 10
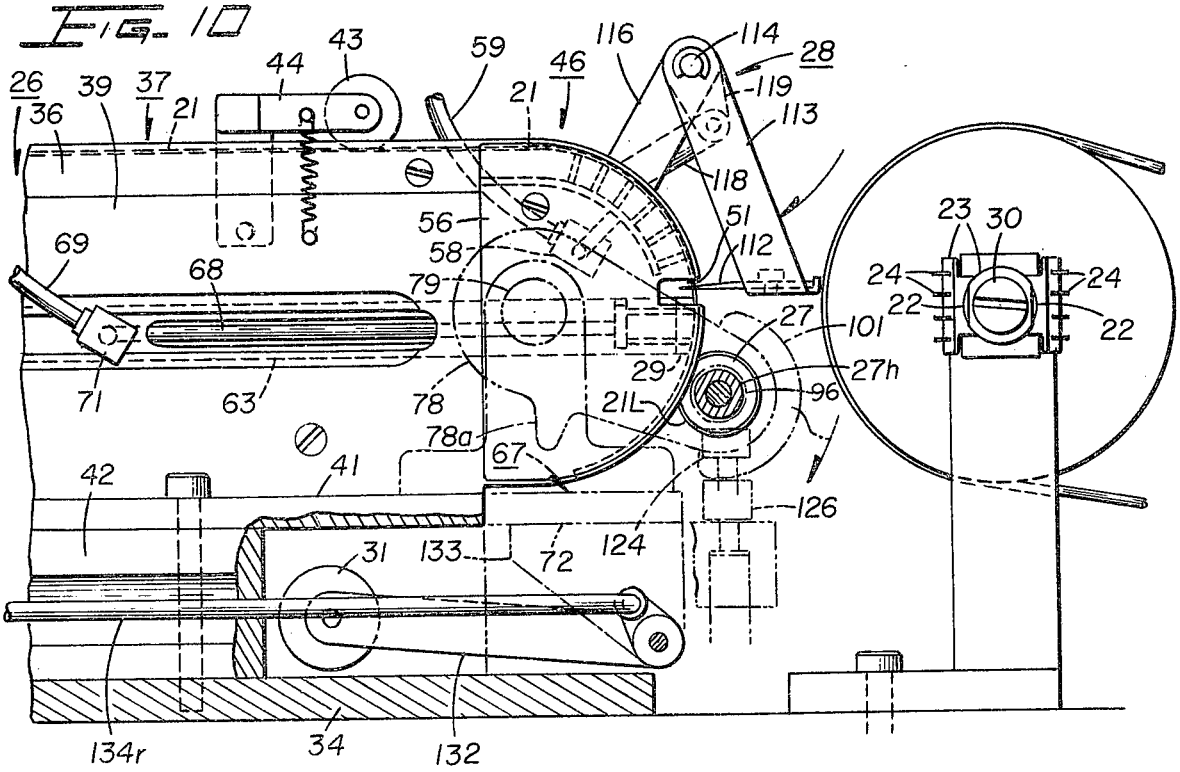

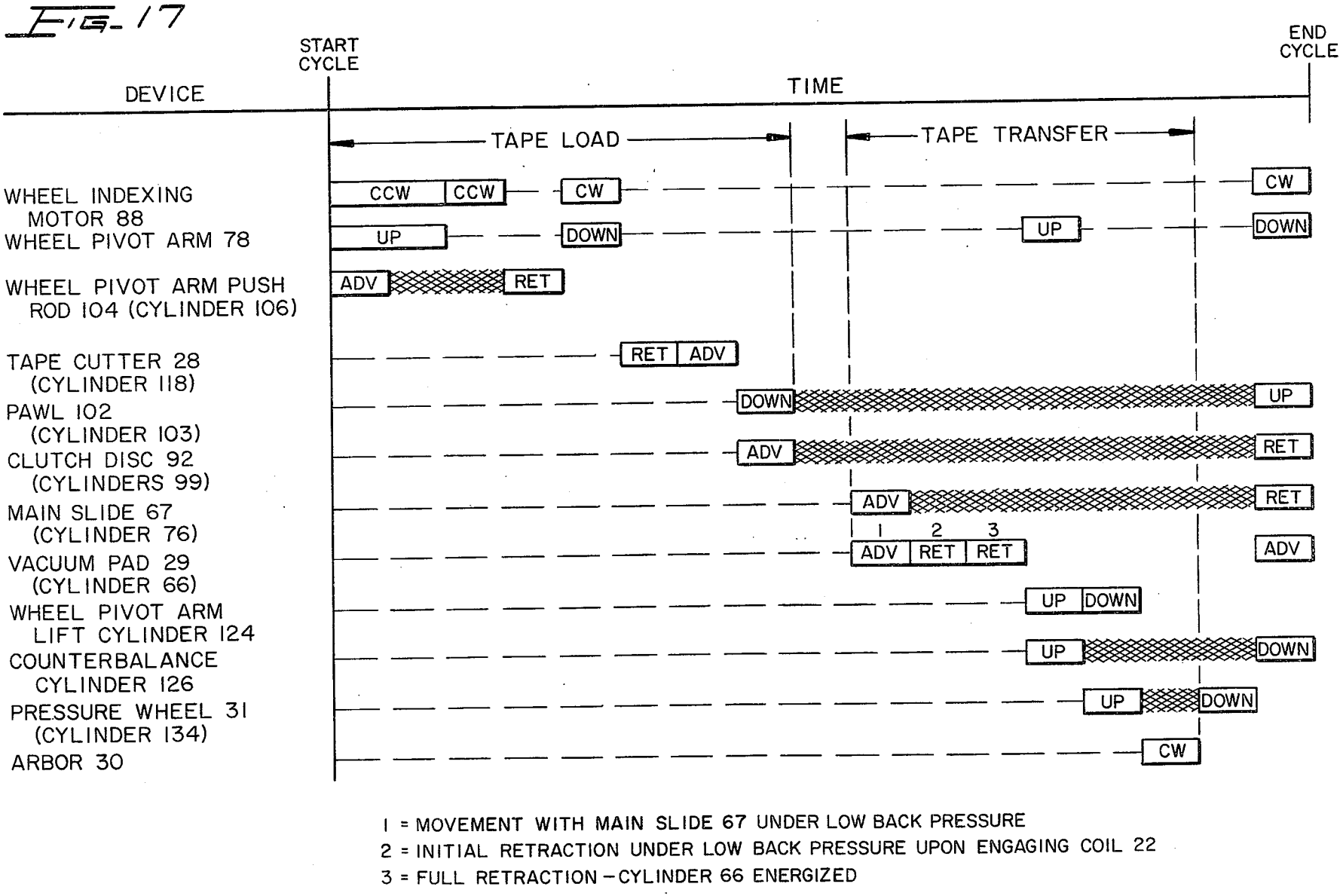
FIG. 17
DEVICE
START CYCLE
TIME
END CYCLE
TAPE LOAD
TAPE TRANSFER
WHEEL INDEXING MOTOR 88
WHEEL PIVOT ARM 78
WHEEL PIVOT ARM PUSH ROD 104 (CYLINDER 106)
TAPE CUTTER 28 (CYLINDER 118)
PAWL 102 (CYLINDER 103)
CLUTCH DISC 92 (CYLINDERS 99)
MAIN SLIDE 67 (CYLINDER 76)
VACUUM PAD 29 (CYLINDER 66)
WHEEL PIVOT ARM LIFT CYLINDER 124
COUNTERBALANCE CYLINDER 126
PRESSURE WHEEL 31 (CYLINDER 134)
ARBOR 30
CCW
CW
UP
DOWN
ADV
RET
1 = MOVEMENT WITH MAIN SLIDE 67 UNDER LOW BACK PRESSURE
2 = INITIAL RETRACTION UNDER LOW BACK PRESSURE UPON ENGAGING COIL 22
3 = FULL RETRACTION – CYLINDER 66 ENERGIZED CONTROLLER
FROM APPARATUS LIMIT SWITCHES
REV MOTOR
CW
CCW
TO SOLENOID VALVES
FROM SV 163
FROM SV 163
VACUUM PUMP
AIR SUPPLY
TO PV 161
TO PV 166
TO PV 166

METHOD OF AND APPARATUS FOR TAPING AN ARTICLE

BACKGROUND OF THE INVENTION

1. Field of the Invention

This invention relates to a method of and apparatus for taping an article in which a preselected length of tape is severed from a tape supply prior to winding the preselected length of tape on the article.

2. Description of the Prior Art

It is standard practice in the manufacture of certain types of electrical coils formed by winding wires on a plastic bobbin, to wind a preselected length of protective electrically insulating adhesive tape about the windings of the coils. In automatic machines for this purpose, such as is disclosed in the U.S. Pat. No. 3,350,255 issued Oct. 31, 1967 to R. W. Twigg, a leading end portion of the adhesive tape is adhered to the outermost winding of the coil and the bobbin is rotated to wind a preselected length of the tape about the winding while pulling the tape from a tape supply. The tape then is cut between the portion of the tape wound on the coil and the tape supply, and the trailing end of the wound tape is pressed down onto the coil. Similar apparatus also is shown in the U.S. Pat. No. 3,314,452 to J. S. Cartwright et al. issued Apr. 18, 1967 and the U.S. Pat. No. 3,713,599 to N. F. Smith et al. issued Jan. 30, 1973. In apparatus of this type, to reduce the tension in the tape as it is pulled from the tape supply, the tape may be routed about a guide roller mounted on a spring loaded tension arm, as for example as disclosed in the U.S. Pat. No. 3,471,098, issued Oct. 7, 1969 to F. J. Jannett.

While prior known apparatus for the taping of electrical coils as above described have been satisfactory where the wire forming the windings of the coil is of relatively large diameter, such as less than 30 gauge (10 mils), difficulties are encountered in utilizing such machines in the taping of coils in which the wire of the coil windings is of smaller diameter. In this connection, the back tension on the tape as it is wound on the coil windings, even where a tension control arm is utilized, tends to break the fine wire in tension between the portions of each winding on the bobbin and its terminations on terminals of the bobbin. There also is a tendency for the tape, as it is pulled from the tape supply, to twist and/or otherwise become misaligned with the coil so that the tape adheres to and rides up on one of the flanges of the bobbin, whereby the tape is not properly wound on the coil in covering relationship. In addition, the twisted and/or misaligned tape also tends to break the wires of the windings on the bobbin in tension. Accordingly, this invention is intended to provide a method and apparatus which is particularly suited for the taping of electrical coils formed with small gauge wire without any significant tape back tension, twisting or misalignment.

The W. Hoffman U.S. Pat. No. 3,834,963, issued Sept. 10, 1974, is directed to the applying of labels to cylindrical containers or cans. In this patent the labels are fed in a continuous strip from a supply to a rotating vacuum feed drum and each label is severed from the supply as the leading end of the label reaches the feed drum. The feed drum then transfers the severed label to a position where the leading end portion of the label is attached to a respective one of the containers. Subsequently, the containers is rotated by engagement between a fixed surface and a traveling belt to wrap the label on the container. Similarly, the J. W. Toensing U.S. Pat. No. 3,159,325, issued Dec. 1, 1964, discloses a taping apparatus in which a tape is fed from a continuous supply and in which pieces of tape are successively cut from the supply and applied to respective articles. However, neither of the devices of these patents are suitable for applying tape to the windings of electrical coils.

SUMMARY OF THE INVENTION

In general, this invention relates to the winding of tape on an article wherein a preselected length of the tape is collected from a supply and the collected tape is severed from the supply. An end portion of the collected tape then is attached to the article and the article is rotated to wind the collected tape onto the article.

More specifically, a rotating tape collecting member is moved toward a tape supply to a position adjacent a tape guide track to securingly engage a leading free end portion of a tape in the guide track. The rotating tape collecting member then moves along the tape and rolls up an initial leading end portion of the tape onto the member. The tape collecting member then may be rotatably driven to wind additional tape onto the member from the tape supply, after which the tape collecting member is moved away from the tape supply. During this movement of the tape collecting member, rotation of the member is precluded such that the movement of the member causes pulling of additional tape from the tape supply along the guide track. The wound tape on the tape collecting member then is severed from the remaining tape extending from the tape supply to form a trailing end portion on the wound tape and a new leading end portion on the remaining tape in the guide track. Subsequently, the rotatable tape collecting member and a vacuum suction member for capturing the trailing end portion of the collected tape, are moved to a position adjacent the article to attach the trailing end portion of the tape to the article. The article is then rotated to wind and transfer the collected tape on the rotatable tape collecting member onto the article.

BRIEF DESCRIPTION OF THE DRAWINGS

FIG. 5 is a partial cross-sectional view taken along the line 5—5 in FIG. 4 and showing a portion of the apparatus in another operating condition;

FIG. 6 is a partial cross-sectional view taken along the line 6—6 of FIG. 4;

FIG. 7 is a partial cross-sectional view taken along the line 7—7 of FIG. 4;

FIG. 10 is a cross-sectional view taken along the line 10—10 in FIG. 3 and illustrating a tape severing operation;

FIG. 16 is an isometric view of a coil which may be taped utilizing the method and apparatus of the invention;

FIG. 17 is a timing chart for the apparatus of the invention; and

DETAILED DESCRIPTION

Referring to FIGS. 13–16, the disclosed embodiment of the invention is directed to a method of and an apparatus for wrapping a preselected length 21L of a plastic insulating tape onto an outer one of a plurality of coils 22 of a plastic bobbin 23. The coils 22 are formed from wires which have been wound on the bobbin 23 with opposite ends of the wires connected to respective terminals 24 of the bobbin in a known manner. In accordance with the subject invention, the tape length 21L is wrapped on the bobbin 23 without any significant back tension, twisting or misalignment which could break the wires of the coils 22 in tension between wound portions of the coils and the bobbin terminals 24. In this connection, the subject invention is particularly adapted to the taping of coils 22 formed of thin wires, such as on the order of 30 gauge (10 mils) or smaller (e.g., 46 gauge or 1.5 mils).

Figure 1:
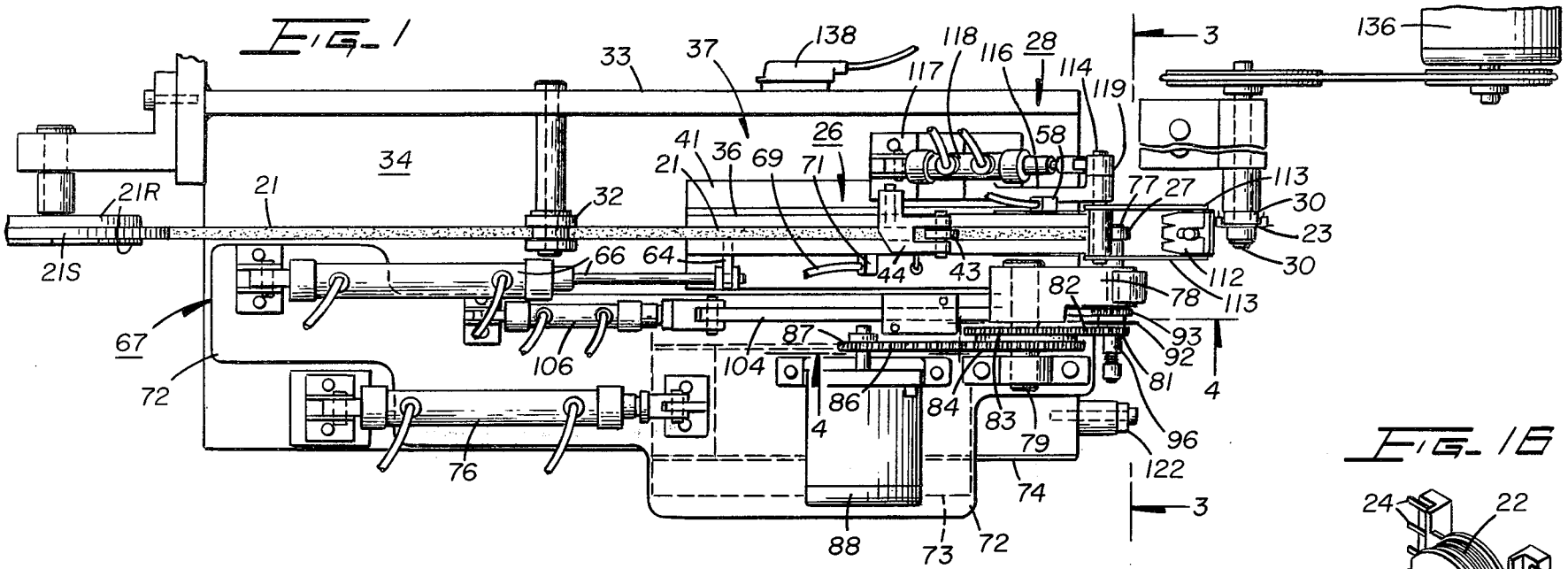
FIG. 1 is a plan view of a tape applying apparatus in accordance with the invention, in an initial operating condition.
Figure 1B:
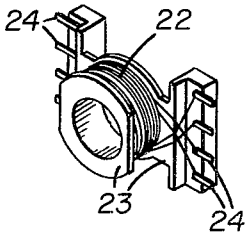
Figure 2:
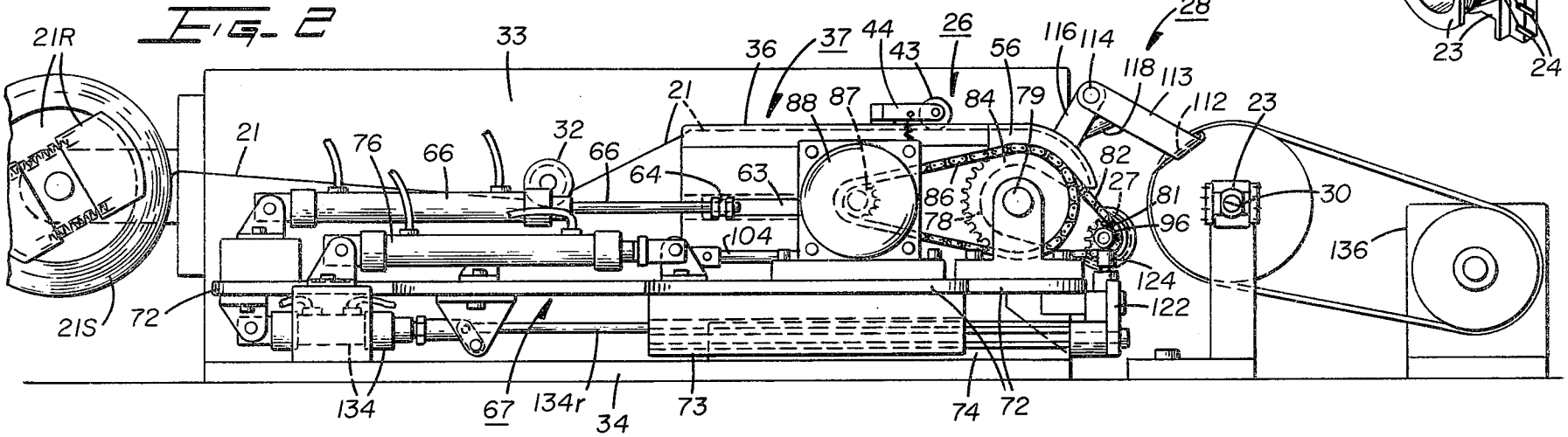
FIG. 2 is a side view of the apparatus of FIG. 1.

Referring to FIGS. 1 and 2, a supply roll 21S of a tape 21 having adhesive coated on one side thereof, is supported on a reel 21R rotatably mounted on a frame of the apparatus adjacent its left-hand end as viewed in these figures. The tape 21 extends to the right in FIGS. 1 and 2 to a tape guide-and-vacuum pad slide assembly 26 at the opposite end of the apparatus where a portion of the tape initially is wound onto a rotatably driven tape collecting-and-transfer wheel 27 in a manner illustrated in FIG. 8. The tape 21 is then severed by a cutting mechanism 28 as shown in FIG. 10 to produce the preselected tape length 21L on the wheel 27.

Figure 13:
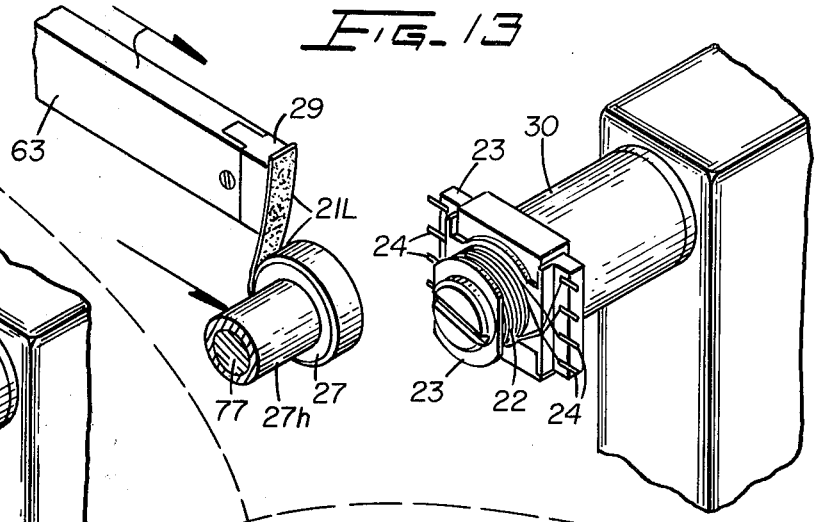
FIGS. 13, 14 and 15 are isometric views illustrating a series of steps in the collected tape transfer operation.
Figure 14:
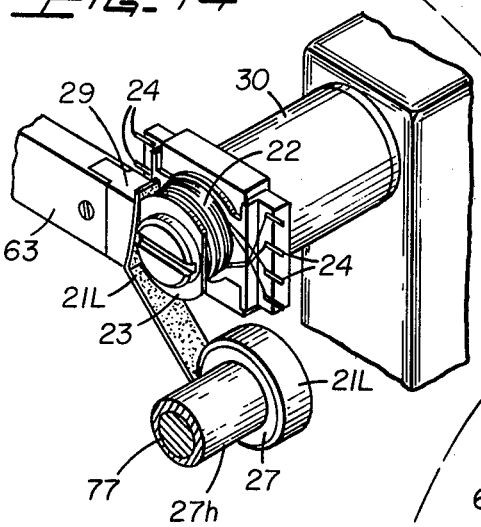
Figure 15:
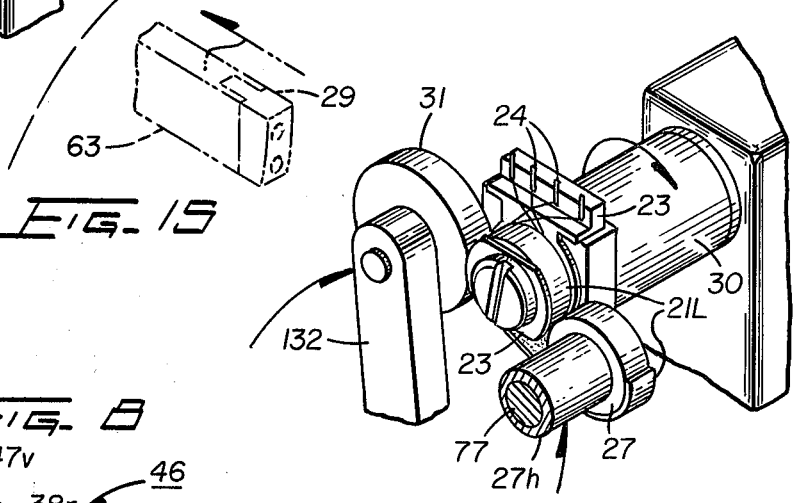
Figure 11:
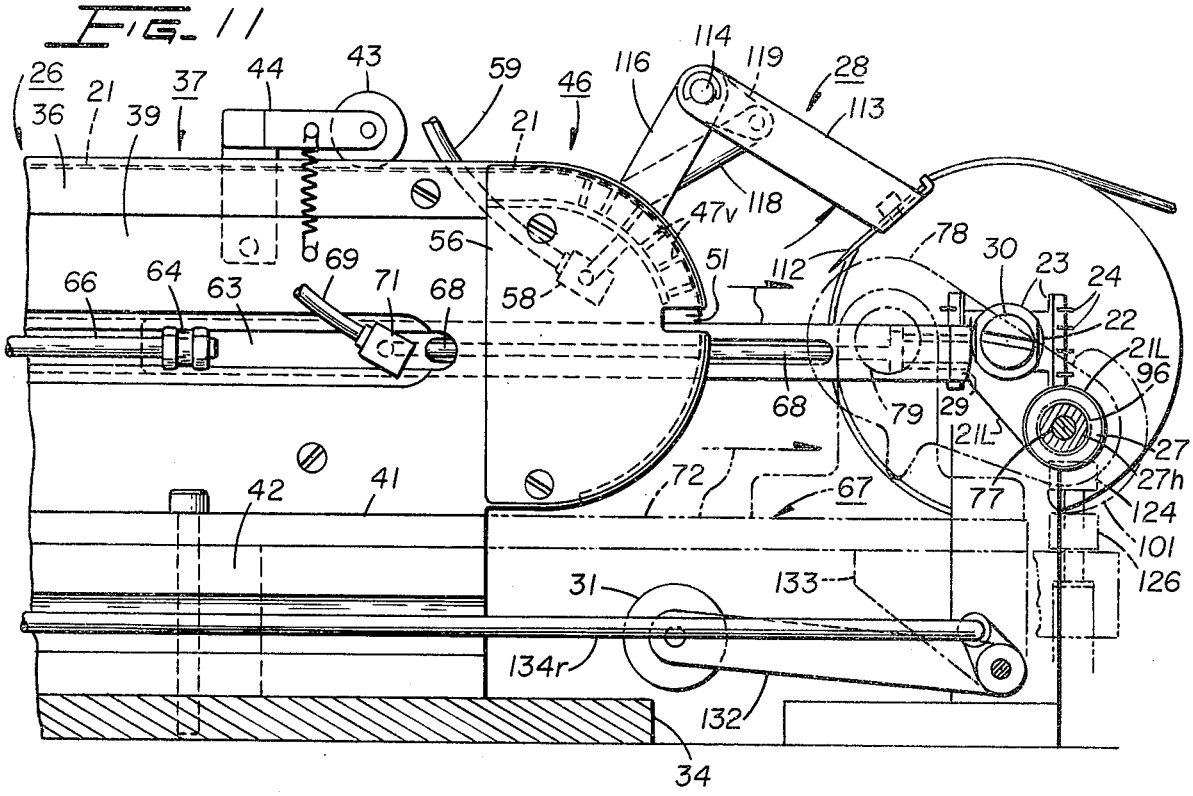
FIG. 11 is a cross-sectional view similar to FIG. 10 and illustrating a first step in a collected tape transfer operation.
Figure 12:
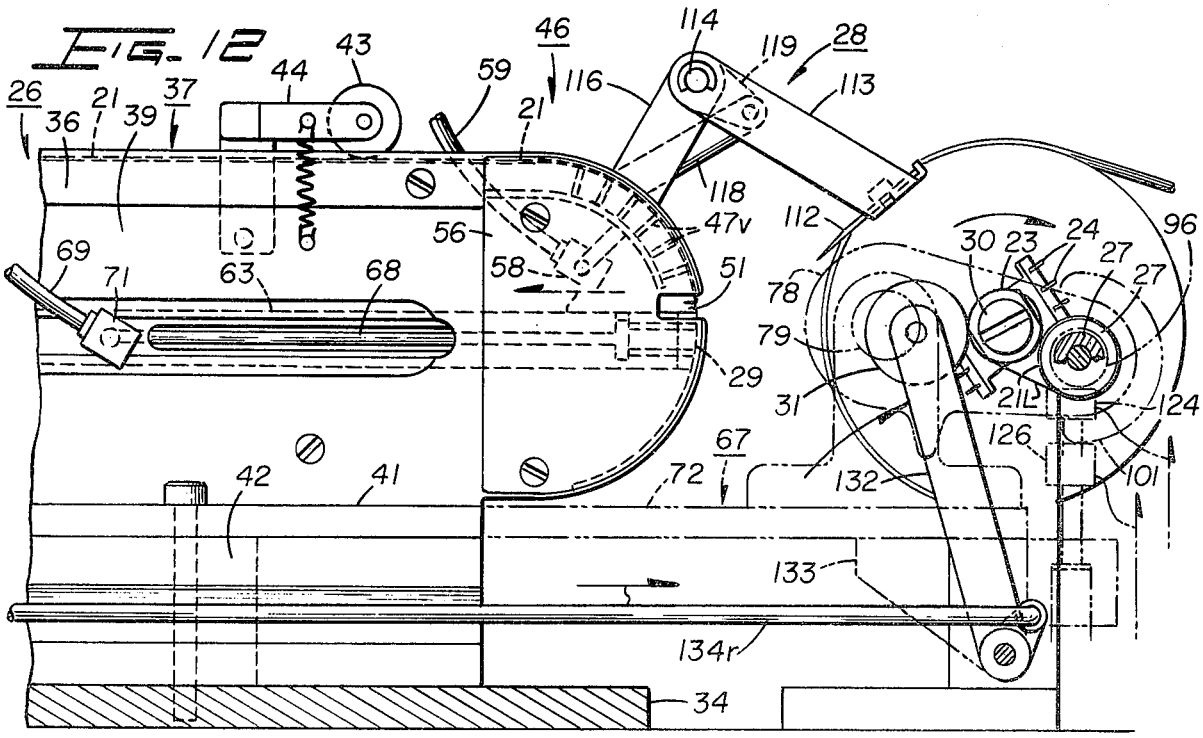
FIG. 12 is a cross-sectional view similar to FIGS. 10 and 11 and illustrating another step in the collected tape transfer operation.

The tape collecting-and-transfer wheel 27, with the wound tape length 21L thereon, next is transferred from a position as shown in FIG. 10, to a position adjacent the bobbin as shown in FIGS. 11 and 14. During this movement a trailing end portion of the tape length 21L, which is being held captured by a horizontally reciprocable vacuum pad 29, moves with the wheel 27 as shown in FIG. 13. The adhesive side of the trailing end portion of the tape length 21L then engages the coil 22 on the bobbin 23 as illustrated in FIG. 14, and is pressed thereagainst by the vacuum pad 29 so that the tape end portion adheres to the coil and becomes attached thereto. At the same time the wheel 27 and the remainder of the tape length 21H continue traveling into their position as shown in this figure, whereupon the vacuum pad 29 is retracted. The wheel 27 and the wound tape length 21L next are moved upward into a position in light engagement with the coil 22 as shown in FIGS. 12 and 15, to reduce the distance between the wheel and the coil to a minimum. The bobbin 23 then is rotated by an arbor 30 on which it is mounted to pull the tape length 21L from the wheel 27 and to transfer the tape length onto the coil 22 in cooperation with a tape pressure roller 31 (FIGS. 12 and 15).

With further reference to FIGS. 1 and 2, the plastic insulating tape 21, with its adhesive-coated side facing upward, extends from the tape supply 21S under a flanged plastic guide roller 32 mounted on a vertical frame plate 33, to the tape guide-and-vacuum pad slide assembly 26, which includes the vacuum pad 29 (best shown in FIG. 8) and which is mounted on a base plate 34 of the apparatus. In the tape guide-and-vacuum pad slide assembly 26 the tape 21 initially travels through a horizontal plastic guide member 36 secured to the top of a support block assembly 37 fixedly mounted at its bottom on the base plate 34. As is best shown in FIG. 7, the support block assembly 37 may include a main block 38 having an upwardly projecting flange to which the guide member 36 is secured, a vertical side plate 39, a horizontal plate 41 and a base block 42, all secured together by suitable screws. The tape 21 is retained in the guide member 36 by a spring biased pressure roller 43 mounted on one end of a carrying arm 44 pivoted adjacent its other end on the main block 38.

Figure 8:
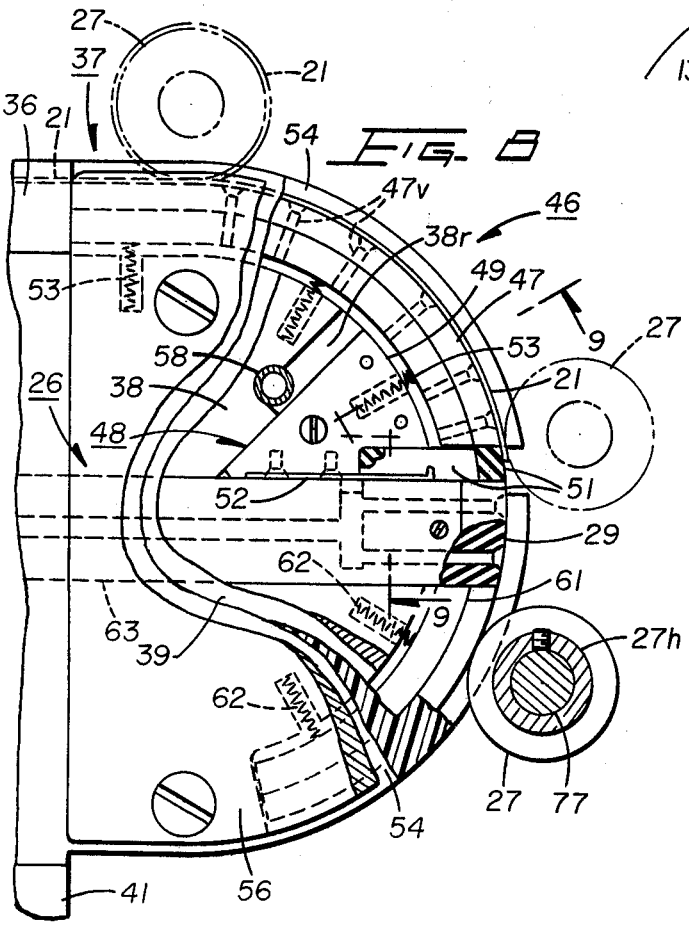
FIG. 8 is a partial cross-sectional view, with portions broken away, taken along the line 8—8 of FIG. 3.
Figure 9:
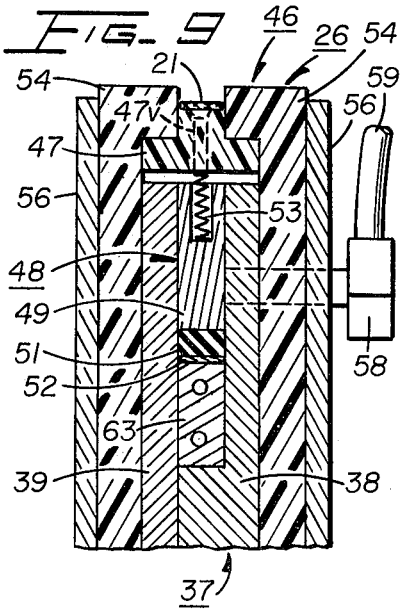
FIG. 9 is a partial cross-sectional view taken along the line 9—9 of FIG. 8.

From the horizontal tape guide member 36 the plastic insulating tape 21 extends into an arcuate guide track 46, shown in detail in FIGS. 8 and 9. A bottom portion of the arcuate guide track 46 is defined by an upper arcuate plastic member 47 which is of an inverted T-shaped construction as viewed in cross section in FIG. 9, having a stem and a pair of oppositely projecting aarms at the lower end of the stem. The stem of the arcuate guide member 47 includes a series of vacuum ports 47*v* for retaining the nonadhesive side of the plastic insulating tape 21 in tight engagement therewith.

The main block 38 includes a triangle-shaped recess in which a backing pad subassembly 48, which cooperates with the tape cutting mechanism 28 (FIG. 10) to sever the tape 21, is mounted. The backing pad subassembly 48 includes a triangular block member 49 removably secured in the recess, a backing pad 51 of a suitable wear-resistant material such as silicone rubber, and a leaf-type retaining spring 52 secured to the triangular block member. The backing pad 51 preferably is of T-shaped construction, having a stem and a pair of horizontally projecting arms (one shown in cross section in FIG. 8) at each side of the stem at its right-hand end as viewed in FIG. 8.

The T-shaped arcuate plastic guide member 47 is resiliently mounted on upper arcuate end surface portions of the support block assembly 37 by small coil springs 53 disposed in the main block 38 and the triangular block 49, to compensate for tape buildup on the tape collecting-and-transfer wheel 27 during a tape collecting or loading operation, as will subsequently be described. Radial outward movement of the tape guide member 47 with respect to the support block assembly 37 is limited by two plastic retaining members 54 having arcuate opposed flanges which are inwardly directed to define opposed sides of the arcuate tape guide track 46 and which overlie the arms of the T-shaped guide member.

Figure 18:
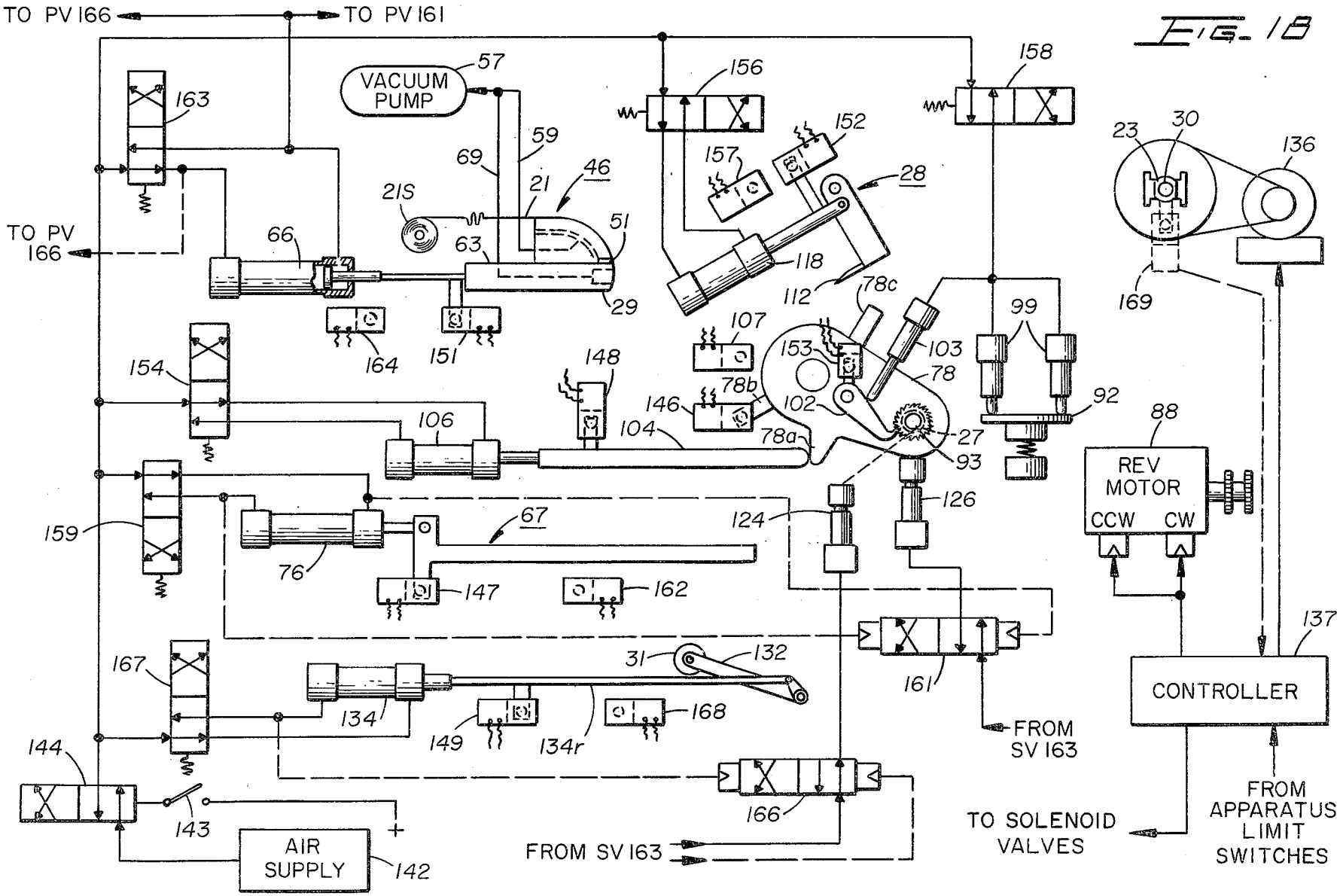
FIG. 18 is a schematic diagram of a control system for the apparatus of the invention.

The plastic retaining members 54 and a pair of associated metal cover plates 56 are removably secured (by screws) to respective opposite sides of the support block assembly 37. The space between the tape guide member 47 and the arcuate end surfaces of the support block assembly 37, and thus the vacuum ports 47*v* in the tape guide member, are connected to a vacuum pump supply 57 (FIG. 18) through a small recess 38*r* (FIG. 8) in the main block 38 and a fitting 58 mounted in the main block and extending through aligned apertures (shown by dashed lines in FIG. 9) in one of the plastic retaining members 54 and its associated cover plate 56, and connected to a vacuum line 59 (FIGS. 9 and 18). The plastic retaining members 54 and the cover plate 56 include aligned notches (FIG. 8) for receiving and supporting the horizontally projecting arms of the T-shaped tape cutting backing pad 51.

The arcuate tape guide track 46 also includes a lower arcuate plastic tape guide member 61 (FIG. 8) of the same T-shaped cross section as the upper arcuate tape guide member 47. As in the case of the upper guide member 47, the lower guide member 61 is resiliently mounted on arcuate end surface portions of the support block assembly 37 by small coil springs 62 disposed in the main block 38, with radial outward movement of the guide member being limited by overlying flange portions of the plastic retaining members 54.

The tape collecting-and-transfer wheel 27, the flanged tape guide roller 32, the tape guide members 47 and 61 and the retaining members 54 may be of any suitable plastic material, such as that available from the E. I. du Pont de Nemours and Company under the trademark "Teflon."

The reciprocable vacuum pad 29 (FIG. 8) of the tape guide-and-vacuum pad slide assembly 26 is disposed between the upper and lower arcuate tape guide members 47 and 61 and immediately below the tape cutting backing pad 51 and its leaf-type retaining spring 52. The vacuum pad 29, like the backing pad 51, preferably is formed of a wear-resistant material such as silicone rubber, and is mounted on one end of a slide rod 63 extending through a passageway defined by portions of the main block 38 and the side plate 39 of the support block assembly 37. Thus, the metal retaining spring 52 also functions as a guide plate between the reciprocable vacuum pad 29 and the backing pad 51 to reduce friction therebetween, whereby any tendency for the reciprocable vacuum pad to wear and/or damage the backing pad is eliminated.

The vacuum pad 29 and the slide rod 63 are reciprocable between a retracted position in which the vacuum pad is in alignment with the arcuate tape guide members 47 and 61 as shown in FIG. 8 for tape collecting (FIG. 8) and severing (FIG. 10) operations, and an extended position (FIG. 11) for a tape transfer operation. As is best shown in FIGS. 2, 7 and 11, the vacuum pad slide rod 63 is secured, by means of a connector member 64 mounted on the rod and extending through an elongated slot in the side plate 39 of the support block assembly 37, to a piston rod of an air cylinder 66 mounted on a horizontally reciprocable main slide assembly 67 (FIG. 2) of the apparatus. Vacuum is supplied to ports of the vacuum pad 51 through a tube 68 (FIGS. 7 and 11) mounted in the slide rod 63 and connected to a vacuum line 69 by a fitting 71 mounted on the slide rod intermediate its ends.

Figure 3:
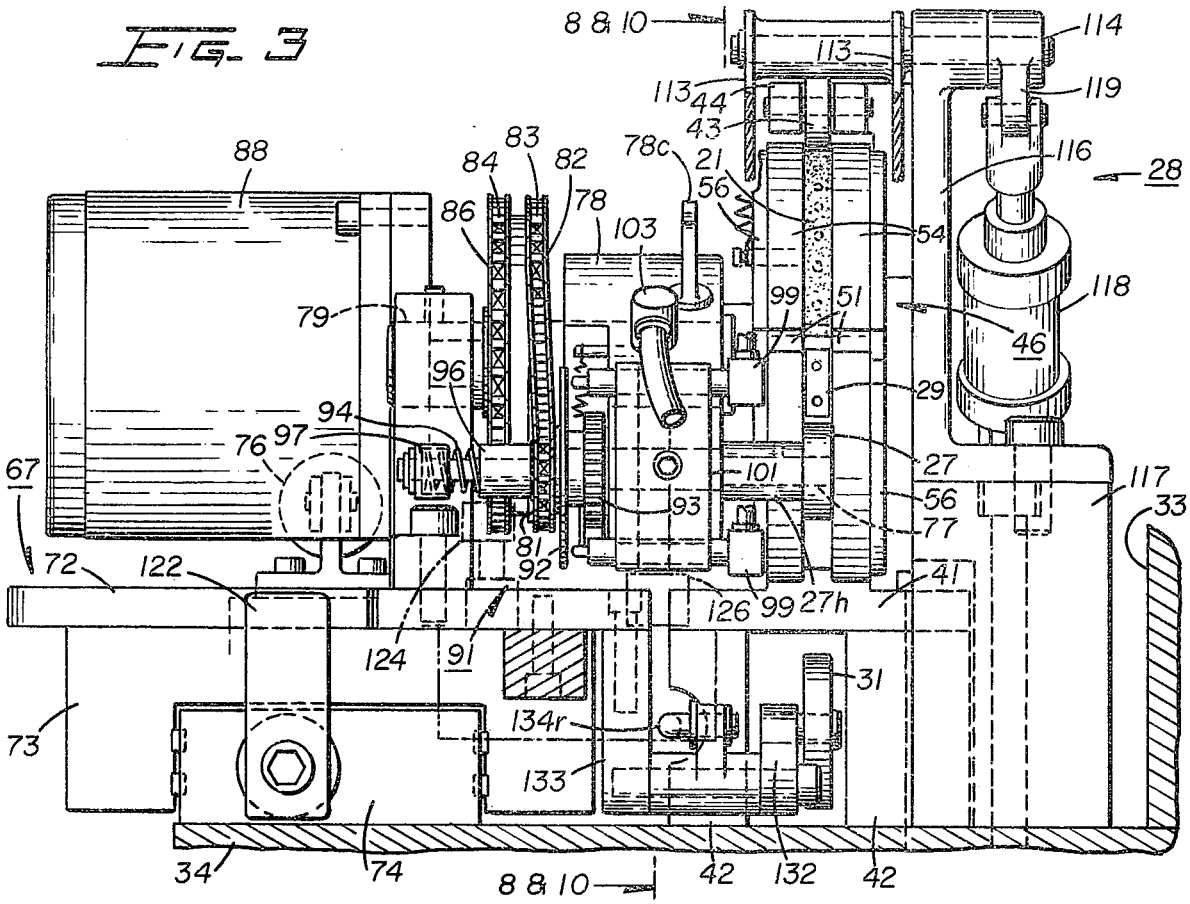
FIG. 3 is an enlarged cross-sectional view taken along the line 3—3 of FIG. 1.

Referring to FIGS. 1, 2 and 3, the main slide assembly 67 includes a horizontal platform 72, on which the vacuum pad air cylinder 66 is mounted and to which a depending support block 73 is secured. The support block 73 is supported by suitable bearings on a guide member 74 (best shown in FIG. 3) fixedly secured to the base plate 34. The main slide assembly 67 is reciprocable between a retracted position, as shown in FIGS. 1 and 2, for the collecting of the tape length 21L on the tape collecting-and-transfer wheel 27, and an advanced position as shown in FIGS. 11 and 12 for the transferring of the tape length from the wheel to the bobbin coil 22, by an air cylinder 76 mounted on the base plate 34.

Referring to FIGS. 1 and 3, the tape collecting-and-transfer wheel 27 and an integral hub portion **27*h* (FIG. 3) of the wheel are fixedly mounted on an end portion of a shaft 77 journalled in a support arm 78 adjacent one end of the arm. The support arm 78 is pivoted adjacent its opposite end (FIGS. 1, 2 and 4) on an end portion of a horizontal shaft 79 fixedly mounted in an upstanding bracket secured at its lower end to the horizontally reciprocable main slide platform 72. The wheel support shaft 77, adjacent the opposite end of the shaft from the wheel 27, has a drive sprocket 81 mounted thereon for rotatable and slidable movement. The drive sprocket 81 is connected by an endless chain 82 to a first sprocket 83 of a dual sprocket member rotatably mounted on a central portion of the support shaft 79 for the wheel pivot arm 78. The dual sprocket member also includes a second sprocket 84 connected by an endless chain 86 to a sprocket 87 on a drive shaft of a reversible synchronous indexing motor 88 mounted on the main slide platform 72**.

The sprocket 81 on the wheel support shaft 77 drives the tape collecting-and-transfer wheel 27 through a releasable clutch mechanism 91 (FIGS. 3 and 5). The clutch mechanism 91 includes a disc plate 92 fixedly mounted on the sprocket 81 for rotatable and slidable movement therewith, and a ratchet 93 fixedly mounted on the wheel support shaft 77. The sprocket 81 and the disc plate 92 are normally urged toward the ratchet 93 by a coil spring 94 disposed about the support shaft 77 between a bushing-receiving portion 96 of the ratchet 81 and one end of a spring housing 97 mounted on the support shaft to permit rotation of the shaft therein. Thus, a pair of projecting pins 98 (visible only in FIG. 5) on the ratchet 93 are receivable in respective apertures in the disc plate 92 to drivingly interconnect the sprocket 81 and the ratchet, as shown in FIG. 3. The sprocket 81 and the clutch disc 92 can be selectively released from driving engagement with the ratchet 93 by operating a pair of small air cylinders 99 mounted on the wheel pivot arm 78 and having piston rods engageable with the clutch disc to move the disc and the sprocket to the left against the action of the coil spring 94 as shown in FIG. 5, so as to disengage the pins 98 on the ratchet from their respective apertures in the disc. The air cylinders 99 are held on the pivot arm 78 by a clamp member 101 secured to the pivot arm by a screw.

Figure 4:
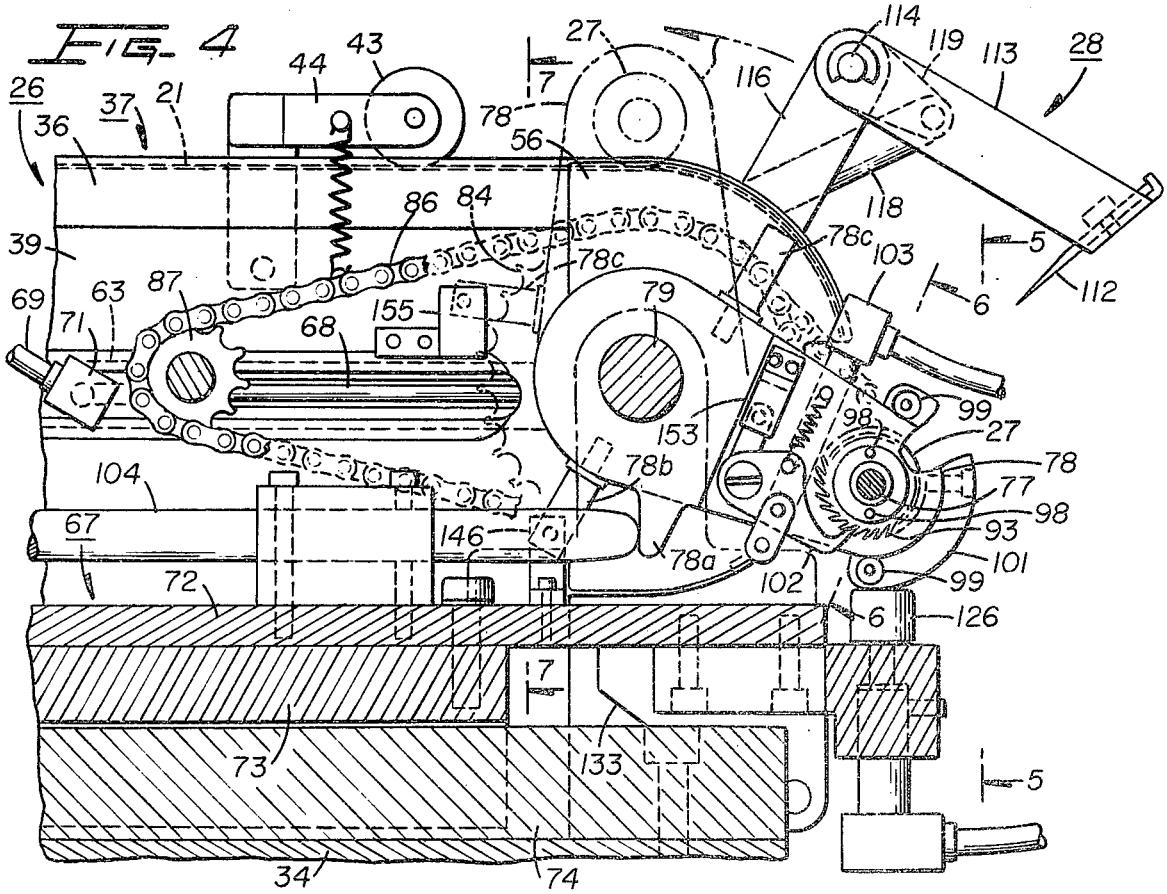
FIG. 4 is an enlarged partial cross-sectional view taken along the line 4—4 of FIG. 1.

As is best shown in FIG. 4, a pawl 102 is pivotally mounted on the wheel pivot arm 78 and is biased by a coil spring so that the pawl normally engages teeth of the ratchet 93 to permit rotation thereof in one direction (counterclockwise in FIG. 4), and to preclude rotation thereof in the reverse direction (clockwise in FIG. 4). The pawl 102 can be selectively released from the ratchet 93 by energizing a small air cylinder 103 mounted on the pivot arm 78 and having a piston rod connected to the pawl by a suitable linkage (FIGS. 4 and 6).

At the beginning of a tape collecting or loading operation the drive motor 88 (FIGS. 1 and 2) is energized to rotate the tape collecting-and-transfer wheel 27 in a first direction counterclockwise as viewed in FIGS. 2 and 8. At the same time a horizontally slidable push rod 104 on the main slide assembly platform 72 is operated by an air cylinder 106 (FIG. 1) which also is mounted on the platform. The push rod 104, by means of a depending lug **78*a* (FIG. 4) on the wheel pivot arm 78**, then pivots the arm counterclockwise to move the wheel 27 from a lower solid line position in FIG. 8 to an intermediate dashed line position in this figure in which the wheel engages a leading end portion of the adhesive side of the tape 21 in the arcuate guide track 46.

The continued rotation of the tape collecting-and-transfer wheel 27 then causes the wheel to roll itself upward on the adhesive side of the tape 21 and to wrap or roll up the tape in the arcuate guide track 46 onto the wheel until the wheel reaches an upper dashed line position in FIGS. 4 and 8, whereupon the wheel drive motor 88 is temporarily de-energized. Preferably, one turn of the tape 21 now has been wound onto the wheel 27 so that the tape will not pull off the wheel as additional tape is wound thereon.

Where additional turns of the tape 21 are to be wound on the tape collecting-and-transfer wheel 27, the drive motor 88 then is re-energized to again rotate the wheel counterclockwise (FIGS. 4 and 8) so that it now pulls the tape 21 from the supply 21S (FIG. 2) and winds the additional number of turns of the tape thereon in a small compact package. During this additional winding of tape 21 onto the wheel 27, while the axis of the wheel is fixed, the increase in effective diameter of the wheel as the result of the additional turns of the tape wound thereon is compensated for by the spring-biased mounting of the upper arcuate tape guide member 47 (best shown in FIG. 8) as described hereinabove.

After winding of the tape 21 on the tape collecting-and-transfer wheel 27 is complete, the motor 88 is de-energized and the air cylinder 106 (FIGS. 1 and 2) is energized to retract the push rod 104 for the wheel pivot arm 78. The drive motor 88 then is energized in a reverse direction (clockwise in FIG. 2). Since rotation of the wheel 27 in this direction is precluded by the ratchet and pawl mechanism 93, 102, the driving action of the sprockets 81, 83, 84, 87 and the chains 82, 86 now cause pivoting of the pivot arm 78 and the wheel 27 back to their initial positions as shown in solid lines in FIG. 4. Further, referring to FIG. 10, during this return movement the wheel 27 pulls additional tape 21 around the arcuate guide track 46 to position a portion of the tape across the tape cutting backing pad 51 and the vacuum pad 29.

The tape cutting mechanism 28 then is operated as shown in FIG. 10 and cooperates with the tape cutting backing pad 51 to sever the tape 21 and to form the tape length 21L on the tape collecting-and-transfer wheel 27. At the same time, a thus formed trailing end of the collected tape length 21L on the wheel 27 is captured by the vacuum pad 29 for subsequent transfer to the bobbin 23.

The tape cutting mechanism 28 includes a tape cutting blade 112 mounted between the lower ends of a pair of lever arms 113 fixedly mounted at their upper ends on a support shaft 114 journalled in an upwardly projecting bracket 116. The bracket 116 is fixedly mounted at its lower end on a support block 117 (FIG. 3) having a stepped top surface and mounted on the base plate 34. Pivotal movement of the cutting blade 112 between an upper inoperative position as shown in FIGS. 2 and 4 and its cutting position as shown in FIG. 10 is accomplished by an air cylinder 118 (FIG. 3) mounted on the support block 117 and having a piston rod connected to a lever arm 119 fixedly mounted on the support shaft 114 for the blade carrying arms 113.

After the cutting of the tape 21 has been completed, the pawl air cylinder 103 (FIGS. 4, 5 and 6) is energized to release the pawl 102 (FIGS. 4 and 6) from the ratchet 93. At the same time, referring to FIG. 5, the clutch air cylinders 99 are actuated to move the clutch disc plate 92 to the left in this figure, to withdraw the pins 98 on the ratchet 93 from their respective apertures in the disc plate, thereby releasing the clutch 91. As a result, the wheel support shaft 77 and the ratchet 93, and thus the tape collecting-and-transfer wheel 27, are conditioned for "free wheeling" rotation during subsequent transfer of the tape length 21L thereon onto the bobbin coil 22, as shown in FIGS. 12 and 15. The tape collecting or loading phase of the apparatus is now complete and the apparatus is ready to proceed into the tape transfer phase of its operation.

As is shown in FIG. 11, in the tape transfer phase of the apparatus, the main slide air cylinder 76 (FIGS. 1 and 2) is energized to move the main slide assembly 67 and the structure thereon, including the tape collecting-and-transfer wheel 27, the vacuum pad 29 and the pressure roller 31, to the right in FIG. 11. In this connection, since the vacuum pad air cylinder 66 is mounted on the main slide assembly 67, this cylinder also moves with the main slide assembly. Further, referring to FIG. 18, since the piston rod of the air cylinder 66 is being retained in an advanced position under low pressure air (e.g., 6 psi) provided through a low pressure gauge (not shown), the vacuum pad 29 and the vacuum pad slide rod 63 on the piston rod also initially move with the main slide assembly 67 to their extended position (FIG. 11) with respect to the remainder of the tape guide-and-vacuum pad assembly 26, which is mounted on the base plate 34.

The vacuum pad 29, which has the trailing end portion of the collected tape length 21L on the tape collecting-and-transfer wheel 27 held thereto and which thus essentially precludes rotation of the wheel and the collected tape length during this portion of the tape transfer operation, as is apparent from FIG. 13, then engages and presses the adhesive side of the tape end portion against the outermost coil turns on the bobbin 23 as shown in FIGS. 11 and 14, under the low back pressure in its air cylinder 66, thus adhering or attaching the tape end portion to the bobbin. At the same time the vacuum pad 29, its slide rod 63, connector 64 and the piston rod of the vacuum pad air cylinder 66 stop while the main slide assembly 67 and the remaining structure thereon, including the vacuum pad air cylinder, continue to be advanced until the main slide assembly support block 73 engages a stop 122 (FIGS. 1, 2 and 3) on the main slide assembly guide member 74. The vacuum pad air cylinder 66 then is operated to retract the vacuum pad 29 from the bobbin 23 as illustrated in FIG. 15, with the adhesion of the tape 21 to the outermost coil 22 overcoming the suction force of the pad on the nonadhesive side of the tape.

Referring to FIGS. 2 and 5, a small lift air cylinder 124 is mounted on the right-hand end of the main slide assembly 67 as viewed in FIG. 2. Following the retraction of the vacuum pad 29, the air cylinder 124 is energized so that a piston rod thereof engages beneath the bushing-receiving portion 96 of the sprocket 81 to move the wheel pivot arm 78 counterclockwise as viewed in FIGS. 11 and 12 until the tape length 21L on the tape collecting-and-transfer wheel 27 has engaged against the outer coil turns on the bobbin 23, as shown in FIG. 12. Thus, the travel distance between the point at which the tape length 21L leaves the wheel 27 and the point at which it is applied to the coil turns on the bobbin 23 is reduced to a minimum so that twisting of the tape length and misorientation thereof on the bobbin as it is transferred from the wheel to the bobbin is substantially eliminated.

The pressure in the lift air cylinder 124 necessary to raise the assembly comprising the tape collecting-and-transfer wheel 27, support shaft 77, wheel pivot arm 78, sprocket 81, clutch disc 92, ratchet 93, spring 94 and housing 97 is of a magnitude which tends to press the collected tape length 21L on the wheel against the outer coil turns on the bobbin 23 such that the wheel and the bobbin are not capable of rotating freely relative to one another. Accordingly, for the transfer of the tape length 21L from the wheel 27 to the bobbin 23, a low pressure air cylinder 126 (best shown in FIG. 4), which is mounted on the main slide assembly 67 adjacent the lift air cylinder 124, is energized simultaneously with the lift air cylinder. The air cylinder 126 exerts a lifting pressure which is only sufficient to counterbalance the weight of the assembly 27, 77, 78, 81, 92, 93, 94 and 97 and holds the assembly in a position as shown in FIG. 12 such that the tape length 21L on the wheel only lightly engages the outer coil turns on the bobbin 23 without any significant frictional engagement therebetween. Thus, after raising the wheel 27 and its associated structure as noted previously, the high pressure lift air cylinder 124 is retracted back to its lower position as shown in FIGS. 2 and 11 for the transfer of the tape length 21L from the wheel 27 to the bobbin 23.

Referring to FIGS. 11, 12 and 15, the plastic tape pressure roller 31 then is moved from a lower advanced position, as shown in FIG. 11, to an upper advanced position, as shown in FIGS. 12 and 15, in which it engages against the outer nonadhesive surface of the trailing end portion of the collected tape length 21L which has been adhered to the outermost coil turns on the bobbin 23. The tape pressure roller 31 is mounted adjacent to an outer end of one leg of a bell crank lever 132 pivotally mounted on a depending bracket 133 (best shown in FIG. 3) on the main slide assembly platform 72. Another leg of the bell crank lever 132 is pivotally connected by a rod **134*r* to a piston rod of an air cylinder 134 (FIG. 2) mounted on the underside of the main slide assembly platform 72. As is best shown in FIGS. 3 and 10, in an initial retracted position the pressure roller 31 is received in a recess in the base block 42 of the tape guide-and-vacuum pad slide assembly 26**.

After the pressure roller 31 has engaged the trailing end of the tape length 21L adhered to the outermost bobbin coil 22, a drive motor 136 (FIGS. 1 and 2) is energized to rotate the arbor 30 on which the bobbin 23 is mounted, to transfer the tape length from the tape collecting-and-transfer wheel 27 onto the coil by rotating the wheel in a reverse direction (clockwise in FIG. 15) from its direction of rotation during the tape collecting operation, thereby pulling the tape length from the wheel and wrapping the tape length onto the coil. During the transfer of the tape length 21L the pressure roller 31 presses the tape into firm engagement with the coil 22 to form a tight wrap. When the arbor 30 has been rotated a sufficient number of turns such that the transfer of the tape length 21L is complete, the arbor motor 136 is de-energized. The apparatus then is restored to its original "start" condition as shown in FIGS. 1–4, the taped bobbin 23 on the arbor 30 is replaced with a new bobbin, and the taping process is repeated.

To facilitate an understanding of the operating sequence of the apparatus as above described, reference is made to the timing chart of FIG. 17. Control of the apparatus to produce the desired operating sequence as shown in FIG. 17 can be accomplished in various manners utilizing a controller 137 (FIG. 18) which may be a programmed or punched-tape type device, contain suitable logic circuitry (not shown), or include a timing cam (not shown) and associated electrical circuits (not shown). The controller 137 may cooperate with appropriately located limit switches on the apparatus as shown in FIG. 18. The limit switches may be of a photodetector type in which a switch actuator operates the switch by blocking or unblocking light from a light emitting diode to a phototransistor, available from the General Electric Company and known as a photon coupled interrupter module No. H-13B2. In addition, the apparatus may include an electrical plug 138 (FIG. 1) mounted on the back of the vertical wall 33 for facilitating connection and disconnection of the apparatus and the controller 137.

With further reference to FIG. 18, which illustrates one manner of controlling the apparatus, at the beginning of a taping cycle, with an air supply 142 having been connected to the system by closure of a manual switch 143 to energize a solenoid valve 144, and with the vacuum pump 57 operating, the apparatus is in a condition as shown in this figure. The tape collecting-and-transfer wheel 27 and its pivot arm 78 are in their down position with a switch actuator **78*b* on the pivot arm operating (blocking) a photodetector limit switch 146 (also shown in FIG. 4). The piston rods of the main slide assembly air cylinder 76, the pivot arm push rod air cylinder 106 and the pressure wheel air cylinder 134 are in retracted positions with associated switch actuators operating (blocking) respective photodetector limit switches 147, 148 and 149. The piston rods of the vacuum pad slide assembly air cylinder 66 and the tape cutter mechanism air cylinder 118 are in advanced positions in their cylinders with associated switch actuators operating (blocking) respective photodetector limit switches 151 and 152. The pawl 102 and the clutch disc 92 are engaged with the ratchet 93, with a switch actuator on the pawl operating (blocking) a photodetector limit switch 153 on the pivot arm 78**.

Upon the depressing of a start button (not shown) in the controller 137, the drive motor 88 (FIGS. 1 and 2) is energized to begin rotating the tape collecting-and-transfer wheel 27 counterclockwise in FIG. 18. At the same time a solenoid valve 154 is energized to operate the air cylinder 106, whereby the switch actuator on the push rod 104 operates (unblocks) the limit switch 148 and the push rod pivots the wheel pivot arm 78 (through its lug **78*a*) counterclockwise so that its switch actuator 78*b* operates (unblocks) the limit switch 146. Pivoting of the wheel 27 continues until it has reached its intermediate position as shown in dashed lines in FIG. 8, in which it engages the leading end of the adhesive tape 21 in the arcuate guide track 46. The rotating wheel 27 then rolls itself up on the adhesive side of the tape 21 and wraps the tape thereon until it reaches its uppermost position as shown in broken lines in FIG. 8, in which it engages a suitable stop (not shown) and a switch actuator 78*c* on the wheel pivot arm 78 operates (blocks) a photodetector limit switch 155 mounted on the support block assembly side plate 39 (FIG. 4). The controller 137 then temporarily de-energizes the drive motor 88**.

Next, the drive motor 88 is re-energized by the controller 137 to wrap additional turns of the tape 21 on the tape collecting-and-transfer wheel 27 as described hereinabove. For this purpose, the controller 137 may include a pulse generator-counter circuit (not shown) which is energized upon operation of the limit switch 155 and which then closes an associated contact in a motor control circuit to restart the drive motor 88. Subsequently, when a preset number of additional turns of the tape 21 has been wound on the wheel 27, the pulse generator-counter circuit de-energizes and winding of the tape on the wheel stops.

The solenoid valve 154 then is de-energized and the air cylinder 106 returns the pivot arm push rod 104 to its initial position in which its associated switch actuator again operates (blocks) the limit switch 148. The drive motor 88 now is energized by the controller 137 in a clockwise direction (FIG. 2) to pivot the tape collecting-and-transfer wheel 27 (which is precluded from rotating by the ratchet and pawl mechanism 93, 102) and its pivot arm 78 back to a down position, causing the pivot arm switch actuator 78*c* to operate (unblock) the limit switch 155 and the pivot arm switch actuator 78*b* to again operate (block) the limit switch 146. During this return movement the tape 21 is pulled from the tape supply 21S (FIG. 1) by the wheel 27 around in the arcuate guide track 46 to position a portion of the tape across the tape cutting backing pad 51 and the vacuum pad 29 as shown in FIG. 10.

Upon operation of the limit switch 146, the drive motor 88 is de-energized and a solenoid valve 156 is energized to retract the piston rod of the air cylinder 118 to operate the tape cutting mechanism 28 so that the tape cutting blade 112 cooperates with the backing pad 51 to cut the tape to form the tape length 21L (FIG. 10) on the tape collecting-and-transfer wheel 27. As the tape 21 is cut, the trailing end of the collected tape length 21L on the wheel 27 is captured by the vacuum pad 29.

As the piston rod of the air cylinder 118 is retracted, its switch actuator first operates (unblocks) the photodetector limit switch 152 and then operates (blocks) a photodetector limit switch 157. This causes the solenoid valve 156 to be de-energized and the piston rod returns the tape cutting mechanism 28 to its initial position, to again cause operation (blocking) of the limit switch 152.

A solenoid valve 158 then is energized to operate the pawl air cylinder 103 to release the pawl 102 from the ratchet 93, and to energize the clutch air cylinders 99 to release the clutch disc 92 from the ratchet, thus making the tape collecting-and-transfer wheel 27 capable of "free wheeling" rotation for the subsequent tape wrapping operation. Release of the pawl 102 causes the switch actuator thereon to operate (unblock) the limit switch 153.

In the tape transfer operating phase of the apparatus, a solenoid valve 159 is energized to operate the air cylinder 76 to move the main slide assembly 67 to the right in FIG. 18 toward its advanced position, whereby its switch actuator operates (unblocks) the limit switch 147. Energization of the solenoid valve 159 also shifts a pilot valve 161 to condition the counterbalance cylinder 126 for operation.

During the advance movement of the main slide assembly 67, the vacuum pad 29, which has the trailing end of the collected tape length 21L (FIG. 13) on the tape collecting-and-transfer wheel 27 held thereto, engages the outermost coil 22 on the bobbin 23, while the main slide assembly continues in its forward movement. This causes a relative shifting of the piston rod of the vacuum pad slide air cylinder 66 within the cylinder to the left in FIG. 18 to a partially retracted position (not shown), whereby its associated switch actuator operates (unblocks) the limit switch 151. When the main slide assembly 67 reaches its forward position, its switch actuator operates (blocks) a photodetector limit switch 162.

Upon operation of the limit switch 162, a solenoid valve 163 is energized to move the piston rod of the vacuum pad slide air cylinder 66 further to the left in FIG. 18 to a fully retracted position (not shown) and its associated switch actuator operates (blocks) a photodetector limit switch 164. Energization of the solenoid valve 163 also causes shifting of a pilot valve 166 and operation of the wheel lift cylinder 124 through the pilot valve, to pivot the tape collecting-and-transfer wheel pivot arm 78 so that the tape length 21L on the wheel 27 engages against the outermost coil turns on the bobbin 23 as shown in FIG. 12. At the same time the counterbalance air cylinder 126 is operated through the preconditioned pilot valve 161.

When the limit switch 164 is operated, a solenoid valve 167 is energized to operate the air cylinder 134, causing the tape pressure wheel 31 to be pivoted into engagement with the end portion of the tape length 21L adhered to the outermost coil turns on the bobbin 23 as shown in FIG. 12. At the same time the spool of the pilot valve 166 is shifted to cause de-energization of the wheel lift cylinder 124. Upon initial operation of the air cylinder 134 its associated switch actuator operates (unblocks) the limit switch 149. When the air cylinder 134 reaches its advanced position, its associated switch actuator operates (blocks) a photodetector limit switch 168.

The arbor drive motor 136 then is energized to rotate the arbor 30 as above described, to transfer the tape length 21L (FIG. 15) from the tape collecting-and-transfer wheel 27 onto the bobbin 23. When the arbor 30 has been rotated sufficiently to complete the tape transfer operation, as determined by a photodetector limit switch 169 adjacent the arbor and a counting circuit (not shown) in the controller 137, the apparatus is restored by the controller to its initial condition as shown in FIG. 18 for the next taping operation. In this connection, the pressure wheel 31 is lowered before retraction of the main slide 67, as is indicated in FIG. 17, to avoid damage to the pressure wheel mechanism when the main slide is retracted.

While the disclosed embodiment of the invention is directed to apparatus for the taping of the wound coils 22 on the bobbin 23 one at a time, it is contemplated that a plurality of devices as disclosed herein could be incorporated into a single machine for the taping of a plurality of the bobbins simultaneously. It also is contemplated that a plurality of devices as disclosed herein may be mounted in a coil winder of the type in which a plurality of the coils 22 are wound and then taped simultaneously, such as that shown in the U.S. Pat. No. 3,713,599 to N. F. Smith et al. In that instance, the arbor 30 would be the coil winding arbor of the coil winder, whereby the rotation of the arbor and certain other operating steps of the apparatus, such as the initiation of the tape collecting (loading) and transfer operations, would be under the control of the coil winder in timed relationship to the coil winding operation.

In summary, a method and apparatus has been disclosed for winding a preselected length of the tape 21 onto the outermost one of the coils 22 on the bobbin 23 in a tight uniform wrap and in proper covering relationship without any significant tape back tension, twisting or misalignment which could cause breakage of the wires of the coils between the wound coil portions on the bobbin and their connections to the bobbin terminals 24.

This is accomplished by initially collecting or loading a preselected amount of the tape 21 onto the rotatably driven tape collecting-and-transfer wheel 27 as illustrated in FIG. 8, and then severing the tape with the tape cutting mechanism 28 as illustrated in FIG. 10 to form the preselected tape length 21L on the wheel. Subsequently, the wheel 27 and the tape length 21L are moved from the tape collecting or loading position, by advancement of the main slide assembly 67, to a position adjacent the bobbin 23 where the captured trailing end of the tape length is attached to the outermost coil 22 of the bobbin 23 by the vacuum pad 29 as shown in FIGS. 11 and 14. The tape length 21L then is transferred from the wheel 27 to the coil 22 with the wheel in its free wheeling state and located closely adjacent the bobbin by the counterbalance cylinder 126 as illustrated in FIGS. 12 and 15. As a result tape back tension, twisting and/or misalignment during the transfer of the tape length 21L from the wheel 27 to the bobbin 23 is eliminated.

The collecting of the preselected tape length 21L on the wheel 27 by winding the tape thereon in a small compact package also is advantageous in that the wheel can be small in size, resulting in a smaller more compact apparatus. The winding of the tape 21 on the wheel 27, wherein the wheel and its pivot arm 78 are pivoted upward from a solid line position as shown in FIGS. 4 and 8, by the push rod 104 until the wheel has reached its intermediate dashed line position in FIG. 8 in which it engages the leading end of the tape, whereupon the rotatably driven wheel then pulls itself upward to its uppermost dahsed line position in FIG. 8 as it wraps an initial turn of the tape onto itself, also provides a convenient method of attaching the leading end of the tape to the wheel for the wrapping of additional turns on the wheel. This arrangement is also advantageous since, as rotation of the wheel 27 is precluded by the ratchet and pawl mechanism 93, 102 as the wheel is returned to its lower position, the wheel functions to advance the tape 21 into its tape cutting position and into proper position for the next operating cycle.

What is claimed is:

1. A method of wrapping tape on an article, comprising the steps of:

rotating a tape collecting means in a first direction to collect tape on the tape collecting means from a tape supply;

severing the tape from the tape supply to form a trailing end portion on the collected tape;

attaching the trailing end portion of the collected tape to the article; and rotating the article to rotate the tape collecting means in a reverse direction, to pull the collected tape from the tape collecting means and to wrap the collected tape onto the article.

2. The method as recited in claim 1, which comprises the additional steps of:

moving the collected tape and the tape collecting means from a tape collecting position to a position adjacent the article between the tape severing and tape attaching steps; and essentially precluding rotation of the collected tape and the tape collecting means during the movement thereof to the position adjacent the article.

3. The method as recited in claim 1, in which the tape collecting step involves:

winding the tape in a plurality of turns onto a tape collecting member.

4. The method as recited in claim 3, in which the tape collecting step involves:

initially moving the tape collecting member toward the tape supply to securingly engage a leading end portion of the tape with the member.

5. The method as recited in claim 4, in which the tape collecting step further involves:

moving the tape collecting member further toward the tape supply to roll up an initial leading end portion of the tape onto the member.

6. The method as recited in claim 4, in which the tape collecting step further includes:

rotating the tape collecting member to pull additional tape from the tape supply and to wind the tape onto the member.

7. The method as recited in claim 5, in which the tape collecting step further involves:

moving the tape collecting member away from the tape supply after tape has been rolled up on the member, while precluding rotation of the member, to pull additional tape from the supply.

8. A method of wrapping tape on an article, comprising the steps of:

moving a tape collecting member toward a tape supply;

attaching a leading end portion of a tape extending from the tape supply, to the tape collecting member;

rolling up a portion of the tape onto the tape collecting member as the member is moved toward the tape supply;

rotating the tape collecting member to wind additional tape onto the member from the tape supply;

moving the tape collecting member away from the tape supply, while precluding rotation of the member, to pull additional tape from the supply;

severing the tape on the tape collecting member from the tape extending from the tape supply to form a trailing end portion on the wound tape on the member and a new leading end portion on the remaining tape extending from the tape supply;

moving the tape collecting member and the severed wound tape thereon to a position adjacent the article;

attaching the trailing end portion of the wound tape on the tape collecting member to the article; and rotating the article to wrap the wound tape on the tape collecting member onto the article.

9. Apparatus for wrapping tape on an article, which comprises:

rotatable means for collecting tape from a tape supply;

means for rotating the rotatable tape collecting means in a first direction to collect tape on the tape collecting means from the tape supply;

means for severing the tape from the tape supply to form a trailing end portion on the tape on the tape collecting means;

means for attaching the trailing end portion of the tape on the tape collecting means to the article; and means for rotating the article to rotate the tape collecting means in a reverse direction, to pull the tape from the tape collecting means and to wrap the tape on the tape collecting means onto the article.

10. Apparatus as recited in claim 9, in which:

the tape collecting means includes a rotatable tape collecting member on which the tape is wound from the tape supply.

11. Apparatus as recited in claim 10, which further comprises:

means for moving the rotatable tape collecting member toward the tape supply to initially engage the member with a leading end portion of the tape, whereupon rotation of the member by the rotating means causes rolling of the member along the tape toward the tape supply and the winding of an initial leading end portion of the tape onto the member.

12. Apparatus as recited in claim 11, which further comprises:

means for limiting the rolling movement of the tape collecting member along the tape, whereupon rotation of the member by the rotating means causes additional tape to be pulled from the tape supply and wound on the member.

13. Apparatus as recited in claim 11, which further comprises:

means for moving the rotatable tape collecting member and the collected tape thereon away from the tape supply; and releasable means for precluding rotation of the tape collecting member as the member is moved by the moving means away from the tape supply, such that the movement of the member causes pulling of additional tape from the tape supply.

14. Apparatus as recited in claim 10, which further comprises:

means for moving the rotatable tape collecting member and the collected tape thereon from a tape collecting position to a position adjacent the article after the tape has been severed by the severing means; and means for essentially precluding rotation of the tape collecting member and the collected tape as the tape collecting member and the collected tape are moved by the moving means to the position adjacent the article.

15. Apparatus as recited in claim 14, in which the rotation precluding means includes:

vacuum suction means for retaining the trailing end portion of the tape in a position adjacent the rotatable tape collecting member, the vacuum suction means being movable with the tape collecting member to the position adjacent the article.

16. Apparatus as recited in claim 14, in which the moving means further includes:

first means for moving the rotatable tape collecting member and the collected tape thereon in a first direction to a position in general alignment with the article; and second means for moving the rotatable tape collecting member and the collected tape thereon in a second direction into a position adjacent the article in which the portion of the collected tape wound on the member engages the article.

17. Apparatus as recited in claim 14, which further comprises:

counterbalancing means for maintaining the portion of the collected tape wound on the member in light engagement with the article as the collected tape is wrapped onto the article.

18. Apparatus for wrapping adhesive coated tape on an article, which comprises:

a guide track for guiding the tape from a tape supply;

first vacuum suction means for retaining a leading end portion of the tape in the guide track;

a rotatable tape collecting member;

means for moving the rotatable tape collecting member toward the tape supply to a position adjacent the guide track to attach the leading end portion of the tape in the guide track to the tape collecting member;

means for rotating the tape collecting member to cause rolling of the member along the tape toward the tape supply to wrap an initial leading end portion of the tape onto the member;

means for limiting the rolling of the tape collecting member along the tape such that rotation of the member by the rotating means causes additional tape to be pulled from the tape supply and wound onto the member;

means for moving the tape collecting member away from the tape supply;

releasable means for precluding rotation of the tape collecting member during the movement of the member away from the tape supply such that the movement of the member causes pulling of additional tape from the tape supply along the guide track;

means for severing the wound tape on the tape collecting member from the remaining tape extending from the tape supply in the guide track, to form a trailing end portion on the wound tape on the member and a new leading end portion on the remaining tape in the guide track;

second vacuum suction means for retaining the trailing end portion of the wound tape on the tape collecting member in a position adjacent the member;

means for moving the rotatable tape collecting member and the second vacuum suction means in a first direction to a position adjacent the article to attach the trailing end portion of the wound tape on the member to the article;

means for moving the tape collecting member and the collected tape thereon in a second direction into a position adjacent the article in which the portion of the collected tape wound on the member engages the article;

means for rotating the article to transfer the wound tape on the rotatable tape collector member onto the article;

counterbalancing means for maintaining the portion of the collected tape wound on the member in light engagement with the article as the collected tape is transferred onto the article; and means for pressing the tape against the article as the tape is wound on the article.

* * * * *